United States Patent [19]

McManus

[11] Patent Number: 4,880,145

[45] Date of Patent: Nov. 14, 1989

[54] SHOWER ACCESSORY

[76] Inventor: Richard P. McManus, 1200 Kapuahi St., Makwao, Hi. 96768

[21] Appl. No.: 140,712

[22] Filed: Jan. 4, 1988

[51] Int. Cl.[4] ..... B67D 5/06

[52] U.S. Cl. ..... 222/192; 222/181; 4/597; 4/605; 312/7.1

[58] Field of Search ..... 222/192, 144.5, 181; 239/289; 4/597, 605, 607, 609–610; 312/7.1, 224, 227, 245

[56] References Cited

U.S. PATENT DOCUMENTS

| | | | |
|---|---|---|---|
| 1,539,051 | 5/1925 | McLean | 312/7.1 X |
| 3,869,183 | 3/1975 | Frank, Jr. | 312/248 |
| 4,105,140 | 8/1978 | Roth | 222/192 X |
| 4,159,788 | 7/1979 | Doyel | 222/181 X |
| 4,425,598 | 1/1984 | Cima | 4/597 X |
| 4,505,078 | 3/1985 | Huh | 312/242 X |

*Primary Examiner*—Joseph J. Rolla
*Assistant Examiner*—Boris Milef
*Attorney, Agent, or Firm*—I. Michael Bak-Boychuk

[57] ABSTRACT

A waterproof assembly for enclosing a variety of articles in a shower includes a backing plate the upper portion of which is provided with a mirror mounted between two light enclosures into which light sockets on a battery housing are inserted from below. A rectangular cover pivoted from the backplate then extends over the battery housing, interlocking a radio enclosure therewith. A plurality of replaceable dispensers are then engaged within the cover, below the radio enclosure, presenting dispensing spouts to the exterior thereof.

3 Claims, 3 Drawing Sheets

SHOWER ACCESSORY

BACKGROUND OF THE INVENTION

1. Field of the Invention

The present invention relates to toiletry dispensing devices, and more particularly to a shower attachment combining a radio with an array of fluid dispensers.

2. Description of the Prior Art

Shower racks and attachments for storing toiletries and the like have been variously implemented in the past. Generally such devices take the form of trays or shelving racks either suspended from the neck of the showerhead or clasped, adhesively fixed or otherwise mounted to the walls of the shower enclosure. In alternative form, dispensing enclosures have been devised in which various soaps, lotions or other fluids are stored for personal use. Enclosures of this type are frequently adhered to the walls of the shower stall and thus include openings for replenishment. Thus, as the fluids are used up the course of replenishment often introduces other fluids which, on occasion, are chemically distinct from the fluid first stored. In consequence, sedimentation and residue build up occur with some frequency requiring periodic cleaning and maintenance.

Concurrently, the recent art now provides fully waterproof radio assemblies. Thus, the convenience of a radio inside the shower stall is now widely accepted along with the other conveniences of storage.

An assembly which combines the foregoing functions without the attendant difficulties is thus desired and it is one such assembly that is set out herein.

SUMMARY OF THE INVENTION

Accordingly, it is the general purpose and object of the present invention to provide a removable enclosure for use in a shower and conformed to receive fluid cartridges on the interior thereof.

Other objects of the invention are to provide a waterproof enclosure conformed to store a radio, an array of dispensing cartridges and waterproof lighting in a single housing.

Yet other objects of the invention are to provide a removeable wall mounted assembly useful in a shower.

Briefly, these and other objects are accomplished within the present invention by providing a generally rectangular enclosure defined by a planar back plate from which a cover is hinged. The rear surface of the back plate may be provided with resilient spacers aligned adjacent offset hanger posts conformed to engage vertical hangers affixed to the wall of the shower enclosure. At the front side the back plate includes a mirror adhesively bonded thereto intermediate two vertical tubular lighting enclosures which at their lower ends communicate into the interior of a transverse battery housing. Thus, two light bulbs fixed in sockets in the battery housing extend into the interior of the lighting tubes and are thereby shielded from direct water contact. A generally rectangular housing shell is then hinged at one lateral edge to the edge of the backplate in a hinging alignment presenting the upper edge thereof above the transverse battery housing. To effect a seal therewith the upper edge includes semicircular cutouts conformed to mate with the exterior of the lighting tubes, with the remaining edge piece abutting the back plate. Thus the upper portions of the battery housing are shielded against direct water spray effecting a secondary seal against water invasion.

The upper edge of the housing shell moreover, is sloped downwardly toward the exterior effecting further a run off surface for the large quantities of water spray normally incident in a shower. A radio receiving cavity is then formed within the housing shell in an alignment subjacent the battery housing. A sealed radio assembly is then received in the cavity including a flexible tube communicating with the battery housing through which the power leads are passed. Immediately below the radio cavity the housing shell is provided with a plurality of clasps each conformed for releasable engagement around the exterior of a corresponding cylindrical dispensing cartridge. A vertical slot in the housing shell at each clasp location then exposes to view the contents of each cartridge.

In this form a varied complement of articles is conveniently mounted for use in a shower in an assembly which provides redundant sealing against water spray.

DESCRIPTION OF THE SPECIFIC EMBODIMENT

Figure 1:
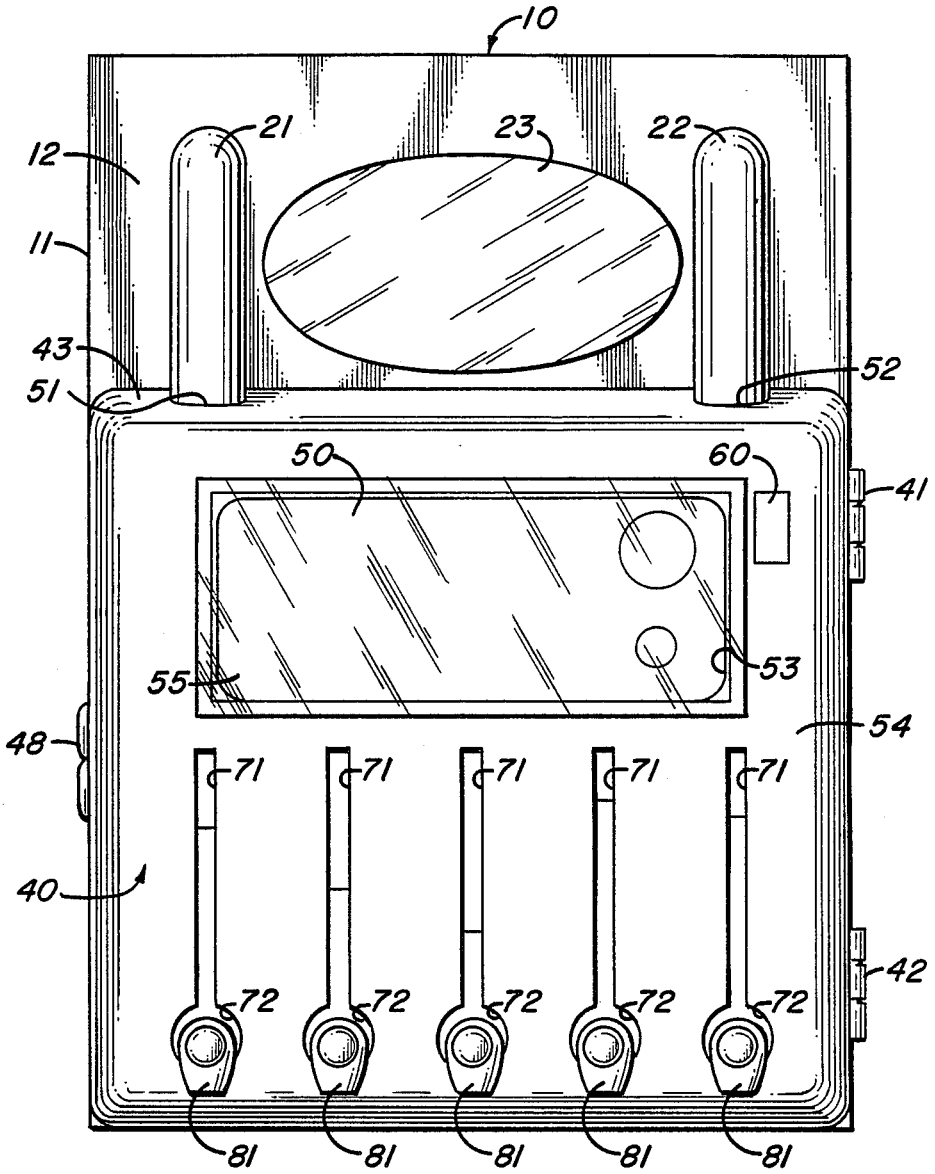
FIG. 1 is a front view of the inventive assembly mounted for use.
Figure 2:
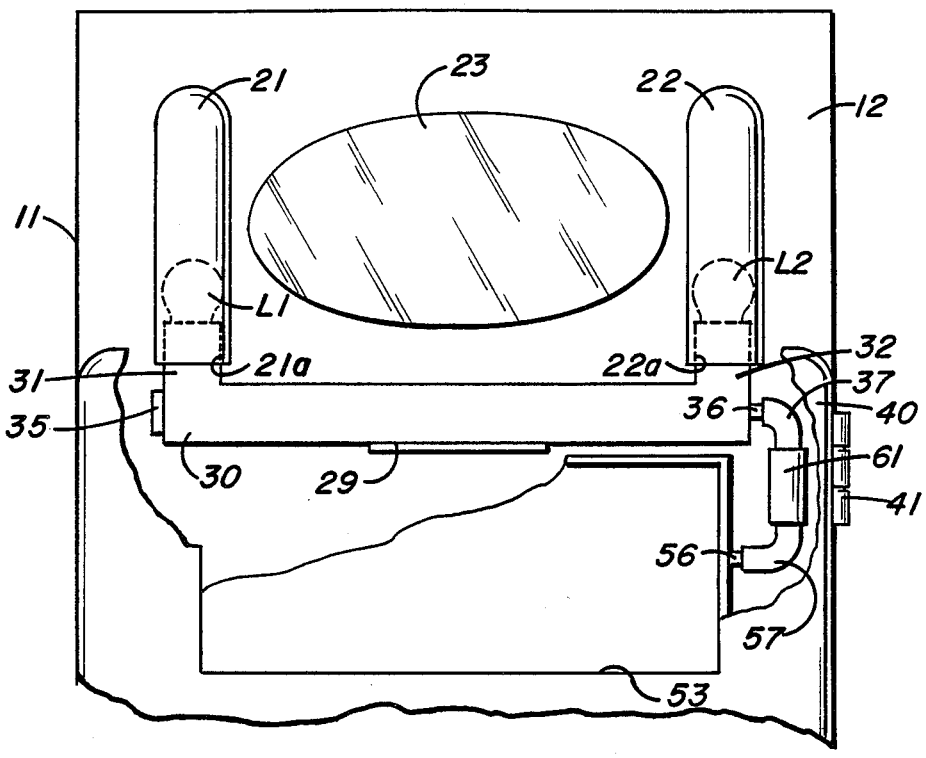
FIG. 2 is a front view sectional detail of the assembly shown in FIG. 1.
Figure 3:
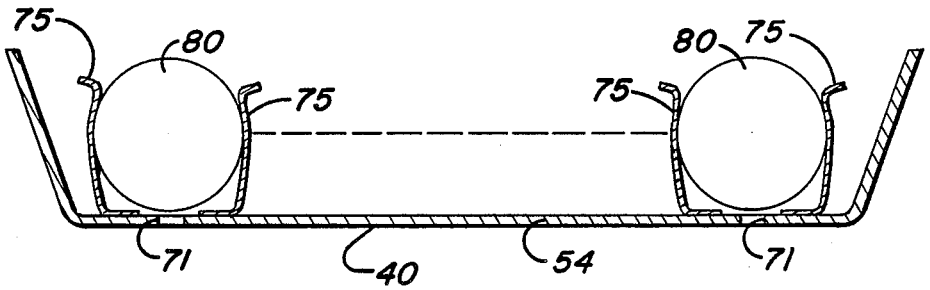
FIG. 3 is a sectional top view taken along line 3—3 of FIG. 1.
Figure 5:
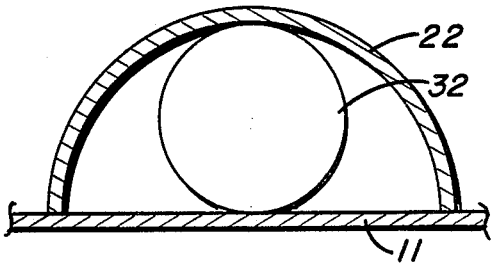
FIG. 5 is a sectional top view detail taken along line 5—5 of FIG. 2.
Figure 4:
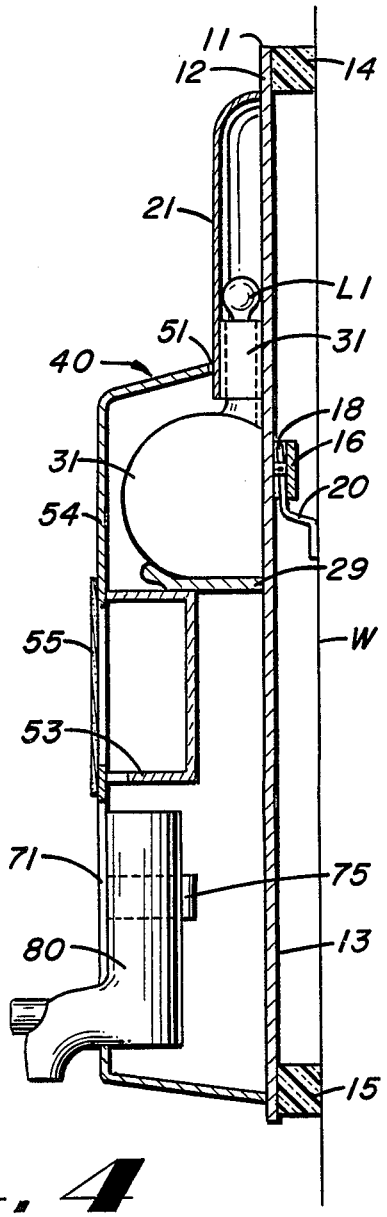
FIG. 4 is a sectional side view taken along line 4—4 of FIG. 1.

As shown in FIGS. 1 through the inventive wall mounted shower assembly, generally designated by the numeral 10, comprises a substantially rectangular, planar, back plate 11 defined by a front surface 12 and a rear surface 13. Attached to rear surface 13, in parallel spaced alignment are upper and lower elongate resilient spacers 14 and 15, respectively. Between these spacers surface 13 is provided with expanded mounting posts 16 conformed for receipt in notches 18 formed in a mount 20 adhesively attached to the wall W of a shower enclosure.

Preferrably the axial dimension of the posts 16 when engaged in the corresponding notches is less than the thickness of the resilient spacers 14 and 15. In consequence, resilient compression of the spacers is effected upon the mounting of plate 11. Thus, mounting and removal are conveniently achieved by compressing the spacers against the wall.

At the front surface 12 plate 11 is provided with two, vertically aligned, translucent cavities 21 and 22 adjacent the lateral edges of a mirror 23 centrally disposed therebetween. Each of the cavities 21 and 22 is generally of a semi-circular section closed at the top and adhesively bonded to the back plate. At the lower edges cavities 21 and 22 form downwardly directed semicircular openings **21*a* and 22*a* conformed to receive light bulbs L1 and L2 mounted in vertical sockets 31 and 32 formed at the ends of the lateral surface of a cylindrical battery housing 30. One end of housing 30 is then provided with a threaded cap 35 allowing access for replacement of conventional dry cell batteries B while the other end is formed into a hose connector 36 insertable into the end of a flexible hose 37**. In this form the batteries B are fully sealed from moisture with the electrical leads therefrom passing into the flexible hose.

Battery housing 30, in turn, is insertable by the sockets 31 and 32 into the openings 21*a* and 22*a* and is retained in this engagement by a resilient tab 29 cantelevered from the front surface 12 below the lower ends of cavities 21 and 22. Sockets 31 and 32, being substantially cylindrical, then form within openings 21*a* and 22*a* corner venting apertures through which any condensate or steam is vented and drained.

A hollow, generally rectangular housing shell 40 is hinged from hinges 41 and 42 on one vertical edge of plate 11 to pivot over a portion of surface 12 including the lower ends of cavities 21 and 22. An inclined upper edge piece 43 forming the upper surface of the shell then extends over the battery housing 30, when the shell is closed, having formed therein two semi-circular edge cutouts 51 and 52 conformed to receive the exterior portions of cavities 21 and 22. Thus, a top surface is formed, inclined for run-off, providing a shield against direct water and soap spray which otherwise would invade the light sockets. Below this shield a radio receiving cavity 53 is formed in the front panel 54 of shell 40 into which a waterproofed radio assembly 50 may be mounted. Cavity 53 may then be covered with a resilient membrane 55 of sufficient compliance to transfer acoustic waves thereacross. Yet another tube fitting 56 may then be provided in the wall of cavity 53 engageable again to a flexible tubing segment 57.

Tubing segments 37 and 57 join to a hermetically sealed switch assembly 60 fixed to the front panel 54 to present a switching selection to the user by way of a switch 61. Cavity 53, moreover, includes in its lower surface a plurality of vents 63 both for drainage and to reduce the backloading of the membrane 55. These vents align immediately above a plurality of vertical slots 71 formed in panel 54 each terminating in a circular port 72 at its lower end. The interior surface of the panel, at each slot 71, is provided with projecting, resilient, paired retainers 75 conformed to engage the exterior cylindrical surfaces of fluid containing dispenser cartridges 80. Each cartridge includes a dispensing nozzle 81 at its lower end extending through ports 72 to the shell exterior.

Thus, a plurality of fluid dispensing nozzles are presented to the user in alignment with the slots 71 through which the fluid content is exposed to view. These same slots also effect venting for any collected steam and as acoustic openings for the sound omitted by the radio.

Of course, shell 40 may be provided with a clasp 48 at its free edge and the interior thereof is thus accessible for replacement of cartridges and cleaning. In this manner a fully functional assembly is devised which is particularly suited for the stringent and invasive environment of a shower.

Obviously, many modifications and changes may be made to the foregoing without departing from the spirit of the invention. It is therefore intended that the scope of the invention be determined solely on the claims appended hereto.

What is claimed is:

1. A dispensing assembly conformed for use in a shower, comprising:

a substantially rectangular backplate conformed for releasable attachment to the walls of said shower and defined by an upper surface portion;

a rectangular cover defined by a forward wall and a peripheral edge extending thereabout pivotally engaged to said back plate to align over said surface portion thereof;

a radio assembly;

an enclosure formed in said forward wall of said cover conformed for receiving said radio assembly therein;

a water impervious membrane adhesively secured to said cover in alignment over said enclosure and said radio assembly to form an outer covering therefor for shielding said radio assembly from water;

a battery housing secured to said backplate in alignment within said cover upon the pivotal articulation of said cover against said back plate, said battery housing including electrical connecting means to said enclosure;

a plurality of engagement means secured to said cover opposed alignment towards said backplate; and a corresponding plurality of liquid dispensers each respectively engageable to a corresponding one of said engagement means and each provided with a dispensing spout communicating to the exterior of said cover.

2. An assembly according to claim 1 further comprising:

lighting means formed on said upper surface of said backplate and communicating with said battery housing; and a mirror affixed on said upper surface of said backplate in adjacent alignment relative said lighting means.

3. An assembly according to claim 2 wherein:

said lighting means includes a translucent enclosure formed on said upper surface of said backplate and providing a downwardly directed opening and a light bulb socket formed in said battery housing for extending into said opening.

* * * * *